US005598672A

United States Patent [19]

Nawa

[11] Patent Number: 5,598,672

[45] Date of Patent: Feb. 4, 1997

[54] PANEL MEMBER MOUNTING STRUCTURE OF CURTAIN WALL

[75] Inventor: Koichiro Nawa, Toyama-ken, Japan

[73] Assignee: YKK Architectural Products Inc., Tokyo, Japan

[21] Appl. No.: 456,928

[22] Filed: Jun. 1, 1995

[30] Foreign Application Priority Data

Jun. 17, 1994 [JP] Japan ..... 6-135458

[51] Int. Cl.[6] ..... E04B 2/88

[52] U.S. Cl. ..... 52/235; 52/204.69; 52/730.5; 52/733.4; 52/734.2

[58] Field of Search ..... 52/235, 730.3, 52/730.4, 730.5, 730.6, 204.53, 204.54, 204.62, 204.69, 204.7, 733.4, 734.2

[56] References Cited

U.S. PATENT DOCUMENTS

| | | | |
|---|---|---|---|
| 3,336,707 | 8/1967 | Horgan, Jr. | 52/733.4 X |
| 3,722,161 | 3/1973 | Brown . | |
| 3,958,383 | 5/1976 | Dallen . | |
| 4,251,964 | 2/1981 | Francis | 52/235 X |
| 4,619,091 | 10/1986 | Gartner | 52/733.4 X |
| 4,756,131 | 7/1988 | Stoakes | 52/235 X |
| 4,756,132 | 7/1988 | Newman et al. . | |
| 4,766,709 | 8/1988 | Galbraith | 52/730.4 X |
| 4,799,344 | 1/1989 | Francis | 52/734.2 X |
| 4,854,095 | 8/1989 | Michlovic | 52/235 |
| 5,018,326 | 5/1991 | Reynolds | 52/235 |
| 5,369,924 | 12/1994 | Neudorf | 52/730.4 X |
| 5,381,637 | 1/1995 | Farag | 52/235 X |

FOREIGN PATENT DOCUMENTS

| | | | |
|---|---|---|---|
| 0231088 | 8/1987 | European Pat. Off. . | |
| WO90/07623 | 7/1990 | European Pat. Off. . | |
| 53-46015 | 12/1978 | Japan . | |
| 2-190548 | 7/1990 | Japan . | |
| 671999 | 10/1989 | Switzerland | 52/204.69 |
| 2133449 | 7/1984 | United Kingdom | 52/235 |
| 2143570 | 2/1985 | United Kingdom | 52/235 |
| 2143558 | 2/1985 | United Kingdom | 52/235 |

*Primary Examiner*—Carl D. Friedman
*Assistant Examiner*—Aimee E. McTigue
*Attorney, Agent, or Firm*—Finnegan, Henderson, Farabow, Garrett & Dunner, L.L.P.

[57] ABSTRACT

A panel member mounting structure for a curtain wall has a frame body comprising a plurality of quadrangular frame sections defined by mullions and transoms. For each quadrangular frame section, a quadrangular gasket consisting of integrally connected left and right vertical gaskets and upper and lower horizontal gaskets is applied. In panel member mounting operation, first the quadrangular gasket is fitted to the mullions and transoms defining a quadrangular frame section, and then the panel member is fitted in the quadrangular gasket by deforming the exterior side holding pieces of the vertical and horizontal gaskets toward the exterior side. Next, while the panel member is temporarily being held by the exterior side holding pieces of the vertical and horizontal gaskets, the zippers are fitted to the gaskets, thereby preventing the deformation of the exterior side holding pieces of the gaskets to fix the panel member firmly.

16 Claims, 6 Drawing Sheets

PANEL MEMBER MOUNTING STRUCTURE OF CURTAIN WALL

BACKGROUND OF THE INVENTION

1. Field of the Invention

The present invention relates generally to a curtain wall. More specifically, the invention relates to a panel member mounting structure of a curtain wall forming an exterior wall of an architecture.

2. Description of the Related Art

As a curtain wall, there is known such construction that a frame body comprising a plurality of quadrangular frame sections is constructed by mullions and transoms, and that panel members such as glasses are mounted on respective quadrangular frame sections.

One of the structures for mounting the panel member on the quadrangular frame section is disclosed in Japanese Unexamined Patent Publication (Kokai) No. Hei 2548, where leg pieces of L-shaped gaskets are inserted into the exterior side portions of mullions and transoms, and arm pieces of the L-shaped gaskets are pressed onto the exterior side surfaces of the panel members, thereby holding the panel members.

Another structure is disclosed in Japanese Examined Patent Publication (Kokoku) No. Sho 53-46015, where a gasket is so constructed that it has a pair of mounting tongue pieces and a pair of panel receiving grooves, each of the panel receiving grooves being defined by a pair of seal lips, one of the seal lips being designed to be deformable toward the exterior side, and fixing strips are detachably provided for preventing the deformable seal lip from deforming toward the exterior side. After the gaskets are fitted to the exterior side portions of the mullions and the transoms, panel members are mounted by deforming the deformable seal lips toward the exterior side, and then, the fixing strips are fitted. Thus, the panel members are held by the gaskets.

In the former panel member mounting structure, the gaskets are installed while the panel member is being held within the quadrangular frame section. That is, work of holding the panel member within the quadrangular frame section is necessary when the gaskets are installed. Holding the panel member within the quadrangular frame section is in itself a cumbersome work. Therefore, the panel member mounting operation this structure is quite cumbersome.

Further, in this structure, since each two gaskets vertically or horizontally adjacent to each other and serving to hold respective panel members are simply in contact with each other, rain water and so forth may penetrate through the contact portion.

In the latter panel member mounting structure, since the panel members are mounted after the gaskets have been installed on the mullions and the transoms, the panel member mounting operation is less cumbersome as far as it goes. However, in this structure, each gasket is formed to have a pair of panel member receiving grooves and is designed to hold a plurality of adjacent panel members, so that the gasket is rather large and heavy. The installation work of large and heavy gaskets is troublesome. Therefore, the panel member mounting operation in this structure is still cumbersome, too.

SUMMARY OF THE INVENTION

It is an object of the present invention to provide a panel member mounting structure of a curtain wall which can solve the problems set forth above.

More specifically, the object of the present invention is to provide a panel member mounting structure which facilitates the panel member mounting operation and ensures satisfactory sealing.

According to the present invention, a panel member mounting structure for a curtain wall comprises:

a frame body formed by a plurality of mullions and a plurality of transoms so as to comprise a plurality of quadrangular frame sections;

a plurality of quadrangular gaskets each formed by a pair of vertical gaskets and a pair of horizontal gaskets integrally connected in quadrangular configuration and each installed on the exterior side of mullions and transoms defining one of the quadrangular frame sections so as to hold a panel member to be mounted in that quadrangular frame section, each of the vertical and horizontal gaskets having a gasket main body and a mounting portion integrally formed with the gasket main body on the interior side thereof, the gasket main body having a panel member receiving groove defined by an interior side receiving piece and an exterior side holding piece integrally connected through a connecting piece and a hollow portion provided in the connecting area of the exterior side holding piece and the connecting piece and opening to the exterior side so as to make the exterior side holding piece deformable toward the exterior side; and a plurality of zippers each having a pair of fitting projections integrally connected through a connecting plate and fitted between a pair of the hollow portions of horizontally adjacent vertical gaskets so as to joint and cover contact edges of the horizontally adjacent vertical gaskets and/or fitted between a pair of the hollow portions of vertically adjacent horizontal gaskets so as to joint and cover contact edges of the vertically adjacent horizontal gaskets.

In a preferred embodiment, the mullion has a mullion body located on the interior side and a projecting plate integrally formed on the exterior side of the mullion body to project toward the exterior side, the projecting plate has a pair of left and right L-shaped plates in the vicinity of the exterior side end and a pair of left and right projecting pieces on the exterior side end, and the L-shaped plates and the projecting pieces cooperate to define a pair of vertically extending left and right hollow grooves each opening to the exterior side for receiving the mounting portion of the vertical gasket. An attachment having a gasket holding piece may be fitted between the mullion main body and the L-shaped plate.

On the other hand, the transom has a transom body located on the interior side, an upper and lower horizontal plates each integrally formed on the exterior side of the transom body to project toward the exterior side and a panel member supporting plate integrally extending from the exterior side end of the lower horizontal plate toward the exterior side, the lower horizontal plate has a pair of upper and lower L-shaped plates in the vicinity of the exterior side end and a pair of upper and lower projecting pieces on the exterior side end, and the L-shaped plates and the projecting pieces cooperate to define a pair of horizontally extending upper and lower hollow grooves each opening to the exterior side for receiving the mounting portion of the horizontal gasket. An attachment having a gasket holding piece may be fitted between the upper horizontal plate and the upper L-shaped plate and/or between the transom body and the lower L-shaped plate.

In another preferred embodiment, the mullion has a mullion body located on the interior side and a pair of projecting plates integrally formed on the exterior side of the mullion body to project toward the exterior side, a gasket supporting plate having a pair of left and right projecting pieces is integrally formed with the mullion to project toward the exterior side, a pair of gasket holders each having a gasket holding piece are connected to the mullion, and the projecting pieces and the gasket holders cooperate to define a pair of vertically extending left and right hollow grooves each opening to the exterior side for receiving the mounting portion of the vertical gasket. An attachment may be fitted between the mullion body and the gasket holder.

On the other hand, the transom has a transom body located on the interior side and an upper and lower horizontal plates each integrally formed on the exterior side of the transom body to project toward the exterior side, a panel member supporting plate having a pair of upper and lower projecting pieces is integrally formed with the transom to project toward the exterior side, a pair of gasket holders each having a gasket holding piece are connected to the transom, and the projecting pieces and the gasket holders cooperate to define a pair of horizontally extending upper and lower hollow grooves each opening to the exterior side for receiving the mounting portion of the horizontal gasket. An attachment may be fitted between the transom body and the gasket holder.

Preferably, the vertical gasket has a pair of grooves formed between the mounting portion and the interior side receiving piece of the gasket main body, and the projecting piece and the gasket holding piece are inserted into the grooves respectively. Similarly, it is preferable that the horizontal gasket has a pair of grooves formed between the mounting portion and the interior side receiving piece of the gasket main body, and that the projecting piece and the gasket holding piece are inserted into the grooves respectively.

The zipper may be formed in cross configuration to be fitted at a joint point of four quadrangular frame sections and to integrally joint and cover contact edges of a pair of vertical gaskets extending upwardly from the joint point, a pair of vertical gaskets extending downwardly from the joint point, a pair of horizontal gaskets extending to the left from the joint point and a pair of horizontal gaskets extending to the right from the joint point. Alternatively, the zipper may be so formed as to extend vertically beyond at least one quadrangular frame section and to joint and cover contact edges of vertically adjacent pairs of vertical gaskets continuously, or to extend horizontally beyond at least one quadrangular frame section and to joint and cover contact edges of horizontally adjacent pairs of horizontal gaskets continuously.

Preferably, wet type seal member is filled between the interior side surface of the panel member and the exterior side surface of the attachment.

BRIEF DESCRIPTION OF THE DRAWINGS

The present invention will be understood more fully from the detailed description given hereunder and from the accompanying drawings of the preferred embodiments of the invention, which, however, should not be taken to be limitative to the present invention, but are for explanation and understanding only.

In the drawings.

DESCRIPTION OF THE PREFERRED EMBODIMENT

The present invention will be discussed hereinafter in detail according to the preferred embodiments of the invention with reference to the accompanying drawings. In the following description, numerous specific details are set forth in order to provide a thorough understanding of the present invention. It will be obvious, however, to those skilled in the art that the present invention may be practiced without these specific details. On the other hand, well-known structures are not shown in detail in order to unnecessarily obscure the present invention.

Figure 1:
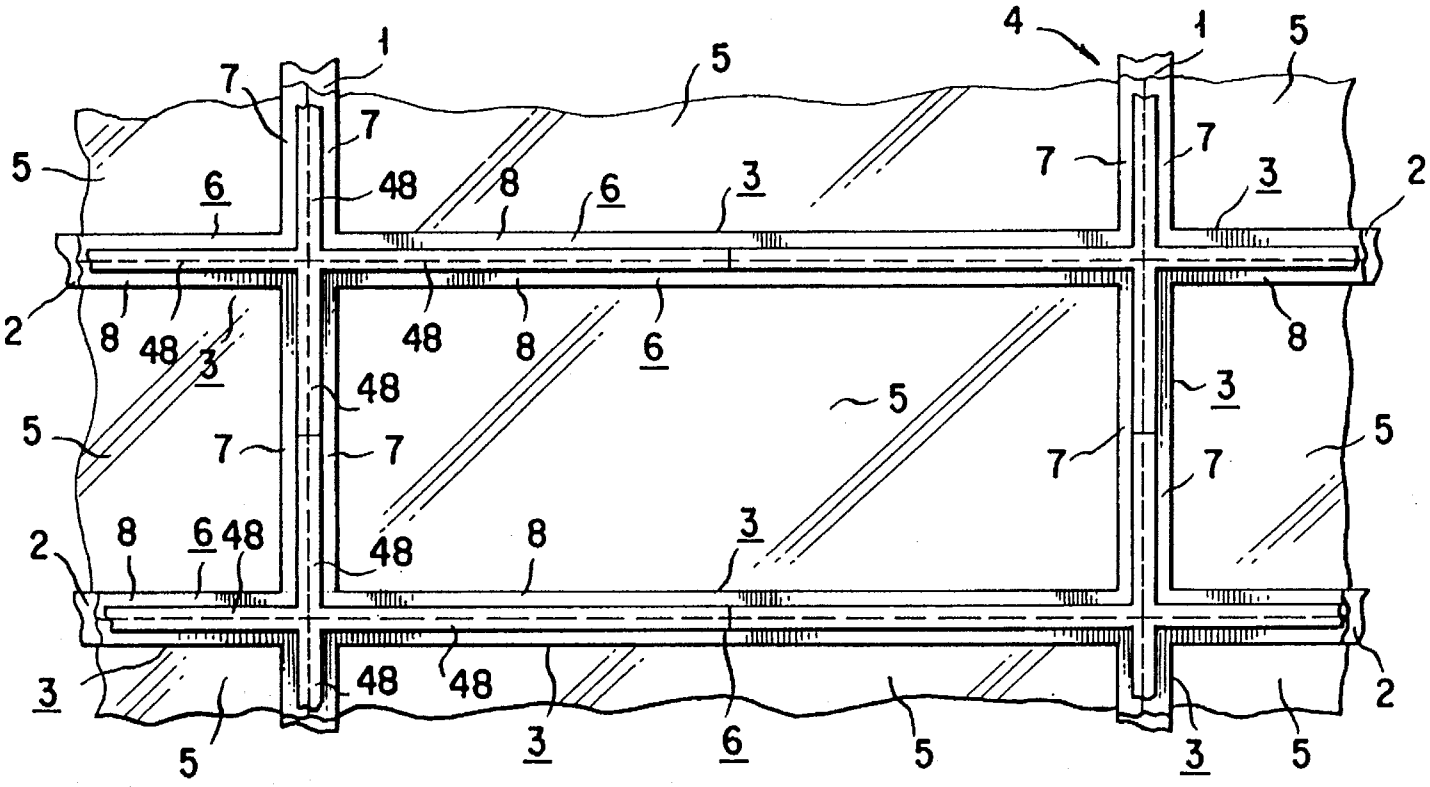
FIG. 1 is a partial front elevation showing an embodiment of a curtain wall according to the present invention.

As shown in FIG. 1, a plurality of mullions 1 are arranged in the face direction having a distance between each other, and a plurality of transoms 2 are connected to the mullions 1, so that a frame body 4 comprising a plurality of quadrangular frame sections 3 is formed. The mullions 1 are connected to a body of an architecture (not shown) by means of fasteners.

Within each quadrangular frame section 3, a panel member 5 is mounted by means of a quadrangular gasket 6. The quadrangular gasket 6 is constituted of left and right vertical gaskets 7 to be installed on respective mullions 1 to extend between the transoms 2 and upper and lower horizontal gaskets 8 to be installed on respective transoms 2. The vertical gaskets 7 and the horizontal gaskets 8 are connected to each other through welding or so forth to form the integrated quadrangular gasket 6.

Figure 2:
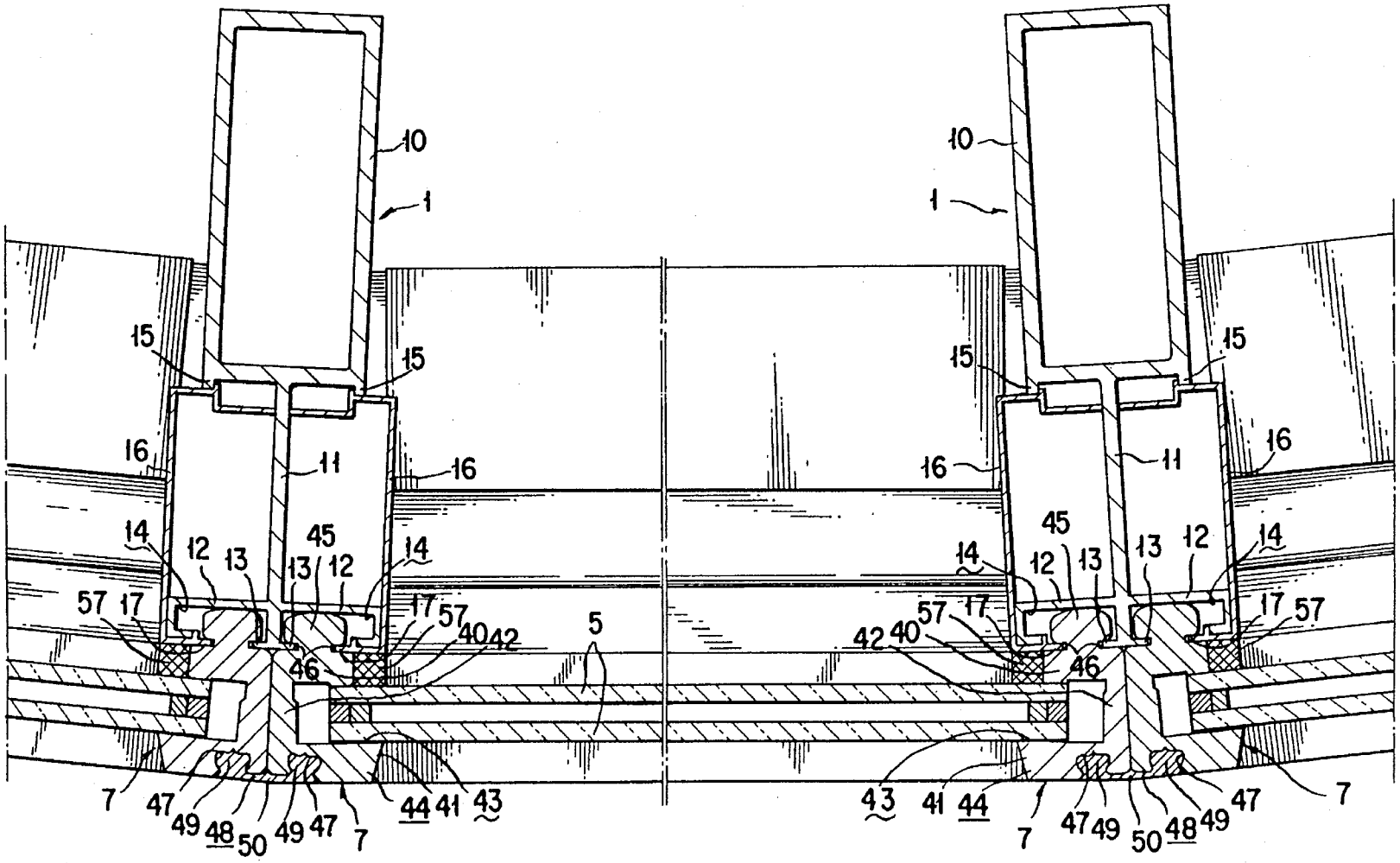
FIG. 2 is a horizontal section of the embodiment of FIG. 1.

As shown in FIG. 2, each mullion 1 has a mullion body 10 located on the interior side and a projecting plate 11 integrally formed at the horizontally middle portion of the exterior side surface of the mullion body 10 and projecting toward the exterior side. The projecting plate 11 has a pair of vertically extending left and right L-shaped plates 12, 12 integrally formed in the vicinity of the exterior side end of the projecting plate 11 and a pair of vertically extending left and right projecting pieces 13, integrally formed on the exterior side end of the projecting plate 11. The L-shaped plates 12, 12 and the projecting pieces 13, 13 cooperate to define a pair of vertically extending left and right hollow grooves 14, 14 each opening to the exterior side. The mullion body 10 has a pair of engaging pieces 15, 15 integrally formed on left and right side ends of the exterior side surface of the mullion body 10, and a pair of mullion attachments 16, 16 are fitted between the engaging piece 15 and the L-shaped plate 12, respectively. Each mullion attachment 16 has a gasket holding piece 17 integrally formed on the exterior side end of the mullion attachment 16 and facing the projecting piece 13. Thus, each mullion attachment 16 also serves as a gasket holder.

Figure 3:
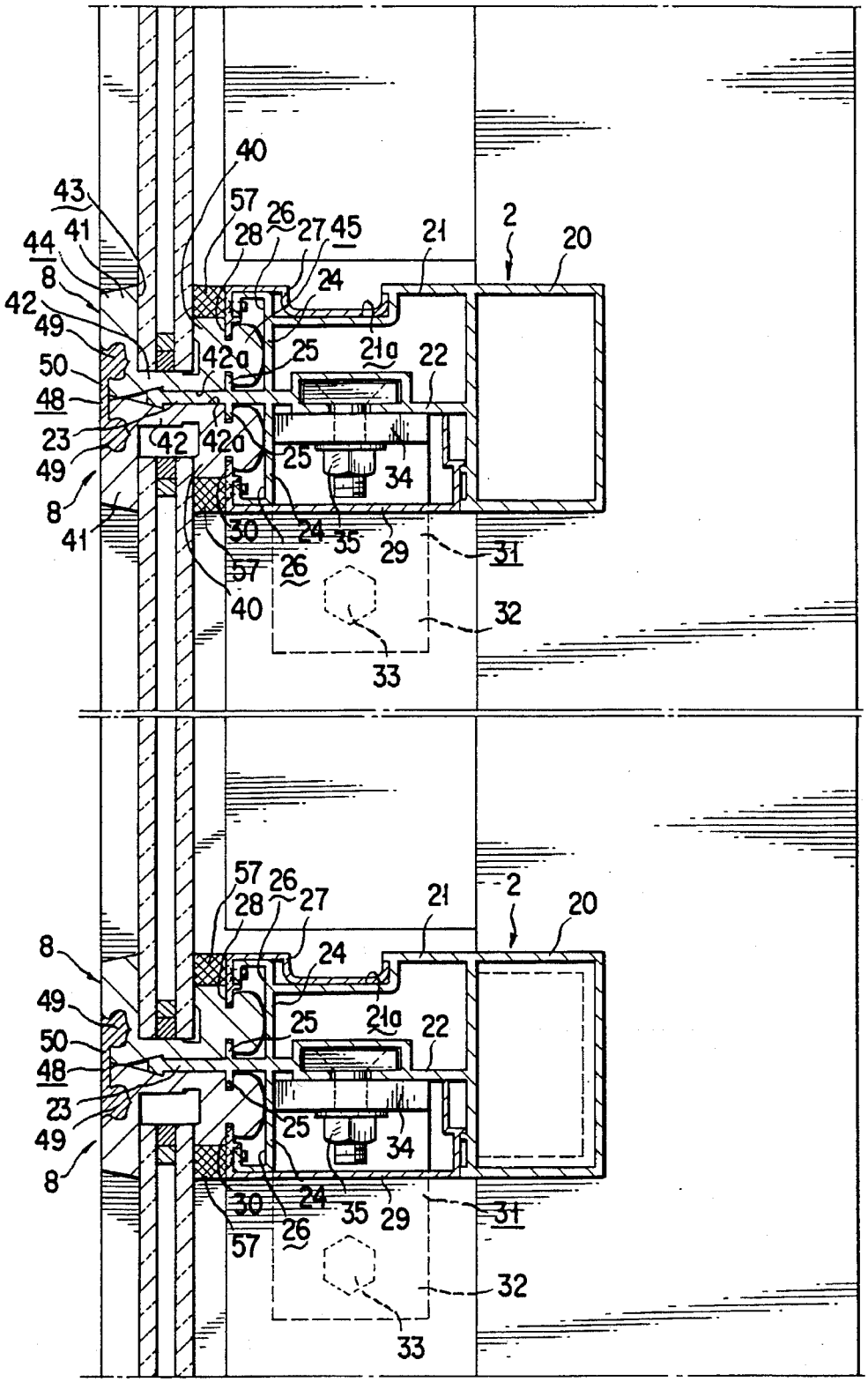
FIG. 3 is a vertical section of the embodiment of FIG. 1.

As shown in FIG. 3, each transom 2 has a transom body 20 located on the interior side, an upper horizontal plate 21 and a lower horizontal plate 22 each integrally formed on the exterior side of the transom body 20, and a panel member supporting plate 23 integrally extending from the exterior side end of the lower horizontal plate 22 toward the exterior side. The lower horizontal plate 22 has a pair of horizontally extending upper and lower L-shaped plates 24, 24 integrally formed in the vicinity of the exterior side end of the lower horizontal plate 22 and a pair of horizontally extending upper and lower projecting pieces 25, 25 integrally formed on the exterior side end of the lower horizontal plate 22. The L-shaped plates 24, 24 and the projecting pieces 25, 25 cooperate to define a pair of horizontally extending upper and lower hollow grooves 26, 26 each opening to the exterior side. The upper L-shaped plate 24 is integrally connected to the upper horizontal plate 21.

The upper horizontal plate 21 has a hollowed portion 21*a*, and an upper transom attachment 27 is fitted between the hollowed portion 21*a* and the upper L-shaped plate 24. The upper transom attachment 27 has a gasket holding piece 28 integrally formed on the exterior side end of the upper transom attachment 27 and facing the upper projecting piece 25. Thus, the upper transom attachment 27 also serves as a gasket holder.

Between the exterior side lower portion of the transom body 20 and the lower L-shaped plate 24 is fitted a lower transom attachment 29. The lower transom attachment 29 has a gasket holding piece 30 integrally formed on the exterior side end of the lower transom attachment 29 and facing the lower projecting piece 25. Thus, the lower transom attachment 29 also serves as a gasket holder.

The transom 2 is put onto and connected to the mullion 1 by means of a L-shaped transom bracket 31.

That is, a vertical piece 32 of the transom bracket 31 is rigidly connected to the projecting plate 11 of the mullion 1 by means of a bolt and nut 33, while a horizontal piece 34 of the transom bracket 31 is rigidly connected to the lower horizontal plate 22 of the transom 2 by means of a bolt and nut 35.

Figure 4:
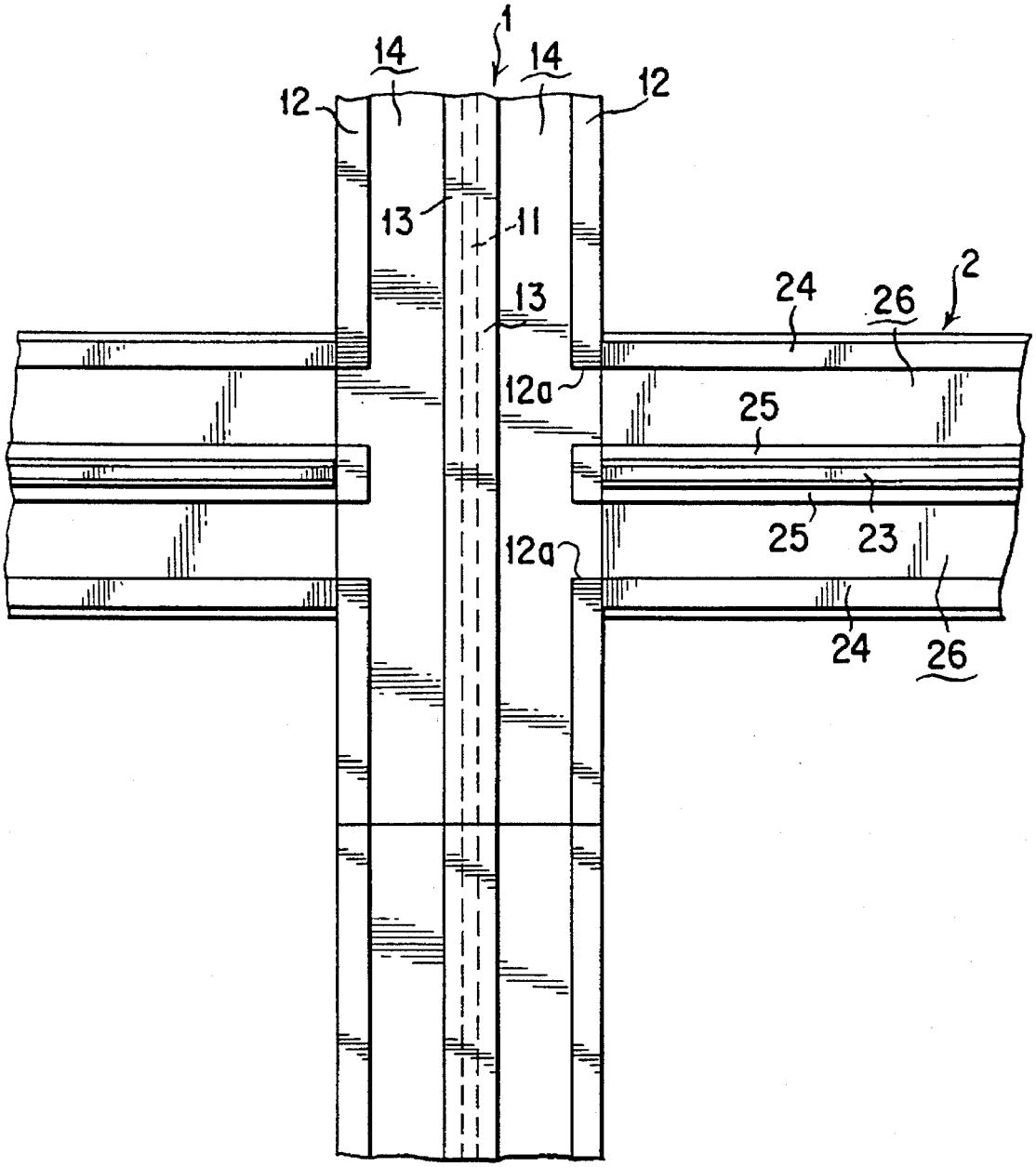
FIG. 4 is a front elevation of a connecting portion of a mullion and a transom.

As shown in FIG. 4, parts of the L-shaped plate 12 of the mullion 1 are cut out so that the vertically extending hollow groove 14 of the mullion 1 is connected to the horizontally extending hollow groove 26 of the transom 2.

As shown in FIG. 2, the vertical gasket 7 has a gasket main body 44 and a mounting portion 45. The gasket main body 44 has a panel member receiving hollow groove 43 defined by an interior side receiving piece 40 and an exterior side holding piece 41 integrally connected through an intermediate connecting piece 42. The mounting portion 45 is integrally formed with the interior side receiving piece 40 of the gasket main body 44. A pair of grooves 46, 46 are formed between the mounting portion 45 and the interior side receiving piece 40 of the gasket main body 44. In the connecting area of the exterior side holding piece 41 and the connecting piece 42, a hollow portion 47 opening to the exterior side is formed through the entire vertical length of the vertical gasket 7, which makes the exterior side holding piece 41 deformable toward the exterior side.

The vertical gasket 7 is installed on the mullion 1 by fitting the mounting portion 45 in the vertically extending hollow groove 14, and inserting the projecting piece 13 and the gasket holding piece 17 into the grooves 46, respectively. The vertical gasket 7 thus installed will never come off the hollow groove 14 even when large force acts on the vertical gasket 7.

The vertical edge portion of the panel member 5 is pressed and held by the interior side receiving piece 40 and the exterior side holding piece 41. Further, a zipper 48 is fitted in the hollow portions 47, 47 of a pair of horizontally adjacent vertical gaskets 7, 7. The zipper 48 serves to prevent the exterior side holding pieces 41, 41 of the horizontally adjacent vertical gaskets 7, 7 from deforming toward the exterior side, and at the same time joints the horizontally adjacent vertical gaskets 7, 7. Since the joint portion of the horizontally adjacent vertical gaskets 7, 7 is covered with the zipper 48, the penetration of rain water and so forth is effectively prevented.

Specifically, the zipper 48 is formed with a pair of fitting projections 49, 49 integrally connected through a connecting plate 50, and the pair of fitting projections 49, 49 are fitted in the hollow portions 47, 47 of the horizontally adjacent vertical gaskets 7, 7.

As shown in FIG. 3, the horizontal gasket 8 has nearly the same cross-sectional configuration as the vertical gasket 7, except that a hollow portion 42*a* is cut out for accommodating the panel member supporting plate 23. The connecting piece 42 of the upper horizontal gasket 8 lies on the panel member supporting plate 23 so that the weight of the panel member 5 is borne by the transom 2. A pair of vertically adjacent horizontal gaskets 8, 8 are pressed to each other in the vicinity of the exterior side ends.

As shown in FIG. 1, the zipper 48 may be formed in cross configuration to be fitted at a joint point of four quadrangular frame sections 3 and to integrally joint and cover contact edges of a pair of vertical gaskets 7, 7 extending upwardly from the joint point, a pair of vertical gaskets 7, 7 extending downwardly from the joint point, a pair of horizontal gaskets 8, 8 extending to the left from the joint point and a pair of horizontal gaskets 8, 8 extending to the right from the joint point. In this configuration, since a zipper to be fitted to an upper pair of vertical gaskets and a zipper to be fitted to a lower pair of vertical gaskets are integrally connected to each other and a zipper to be fitted to a lefthand pair of horizontal gaskets and a zipper to be fitted to a righthand pair of horizontal gaskets are integrally connected to each other, gaps remaining between the gaskets around the joint point are closed and watertightness is enhanced.

Alternatively, the zipper 48 may be so formed as to extend vertically beyond at least one quadrangular frame section 3 and to joint and cover contact edges of vertically adjacent pairs of vertical gaskets 7, 7 continuously, or to extend horizontally beyond at least one quadrangular frame section 3 and to joint and cover contact edges of horizontally adjacent pairs of horizontal gaskets 8, 8 continuously. The same effect can be attained in this configuration.

Between the interior side surface of the panel member 5 and the exterior side surface of each of the mullion attachment 16 and the upper and lower transom attachments 27 and 29, wet type seal member 57 is filled. Therefore, even if the panel member 5 has been displaced relative to the quadrangular frame section 3 due to deformation of the frame body 4, the panel member 5 can smoothly return to the original position when the frame body 4 recovers from deformation.

Next, the panel mounting steps will be explained.

First, the mullions 1 are connected to a body of an architecture, and the transoms 2 are connected between the mullions 1 to form a frame body 4 comprising a plurality of quadrangular frame sections 3.

The left and right vertical gaskets 7 and the upper and lower horizontal gaskets 8 are in advance connected to each other to form an integrated quadrangular gasket 6 in a factory or so forth. Thus integrated quadrangular gasket 6 is installed on the quadrangular frame section 3 by fitting the vertical gaskets 7 in the hollow grooves 14 of the left and right mullions 1 and the horizontal gaskets 8 in the hollow grooves 26 of the upper and lower transoms 2. Then, the mullion attachments 16 and the upper and lower transom attachments 27 and 29 are fitted so as to hold the vertical and horizontal gaskets 7 and 8 and to prevent them from falling off.

Next, the panel member 5 is installed in the panel member receiving grooves 43 by deforming the exterior side holding pieces 41 of the vertical and horizontal gaskets 7 and 8 toward the exterior side. In this condition, the panel member 5 is temporarily being held by the interior side receiving piece 40 and the exterior side holding piece 41. Then, in this condition, the zippers 48 are fitted to the gaskets so as to fix the panel member 5. Lastly, the wet type seal 57 is applied.

Alternatively, it is also possible to first fit the vertical and horizontal gaskets 7, 8 to the panel member 5 continuously around its quadrangular entire periphery to make, as it were, a mounting unit, and then to install such mounting unit in the quadrangular frame section 3 by fitting the vertical gaskets 7 in the hollow grooves 14 of the mullions 1 and the horizontal gaskets 8 in the hollow grooves 26 of the transoms 2.

Figure 5:
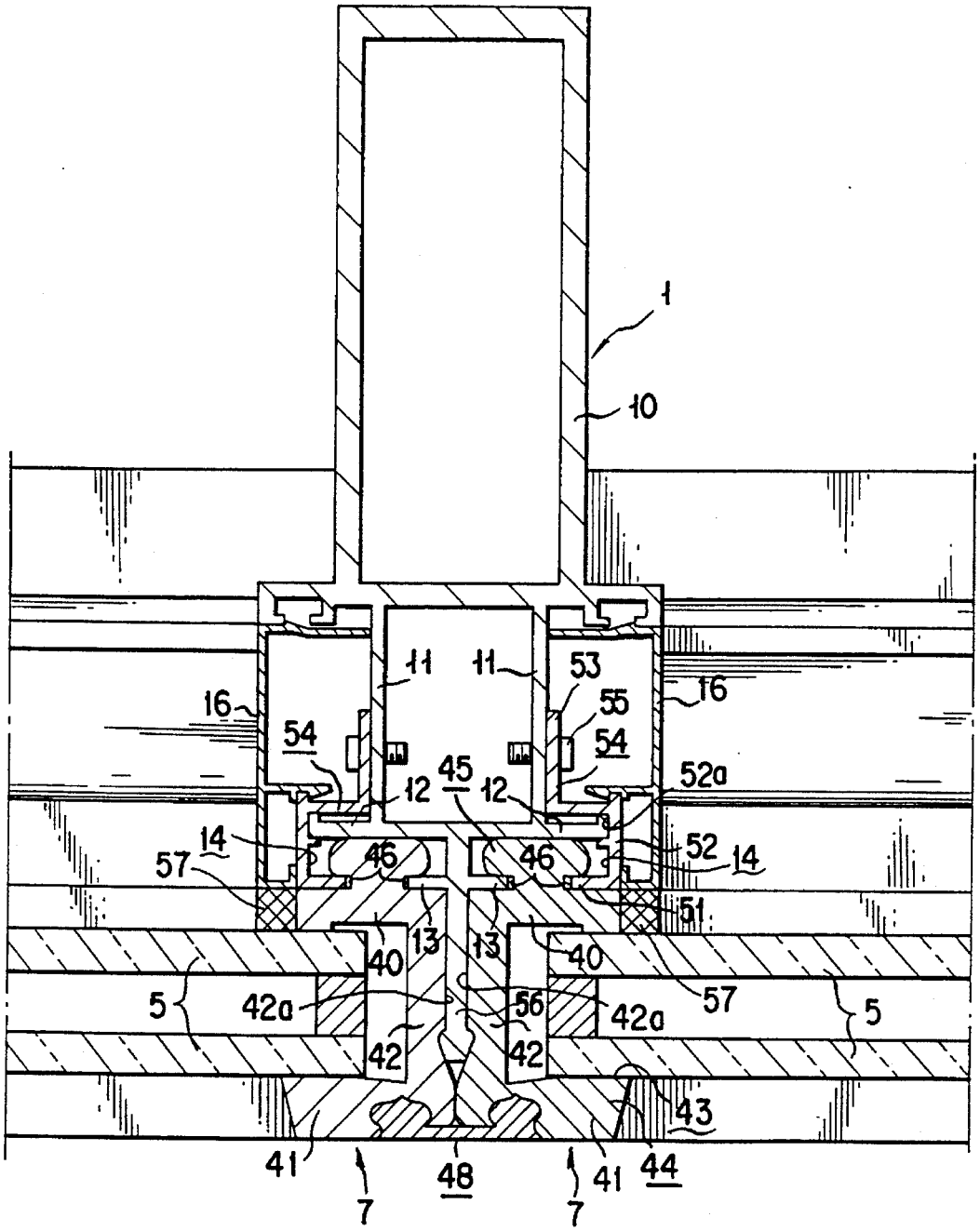
FIG. 5 is a horizontal section of a second embodiment of a curtain wall at the portion of a mullion.
Figure 6:
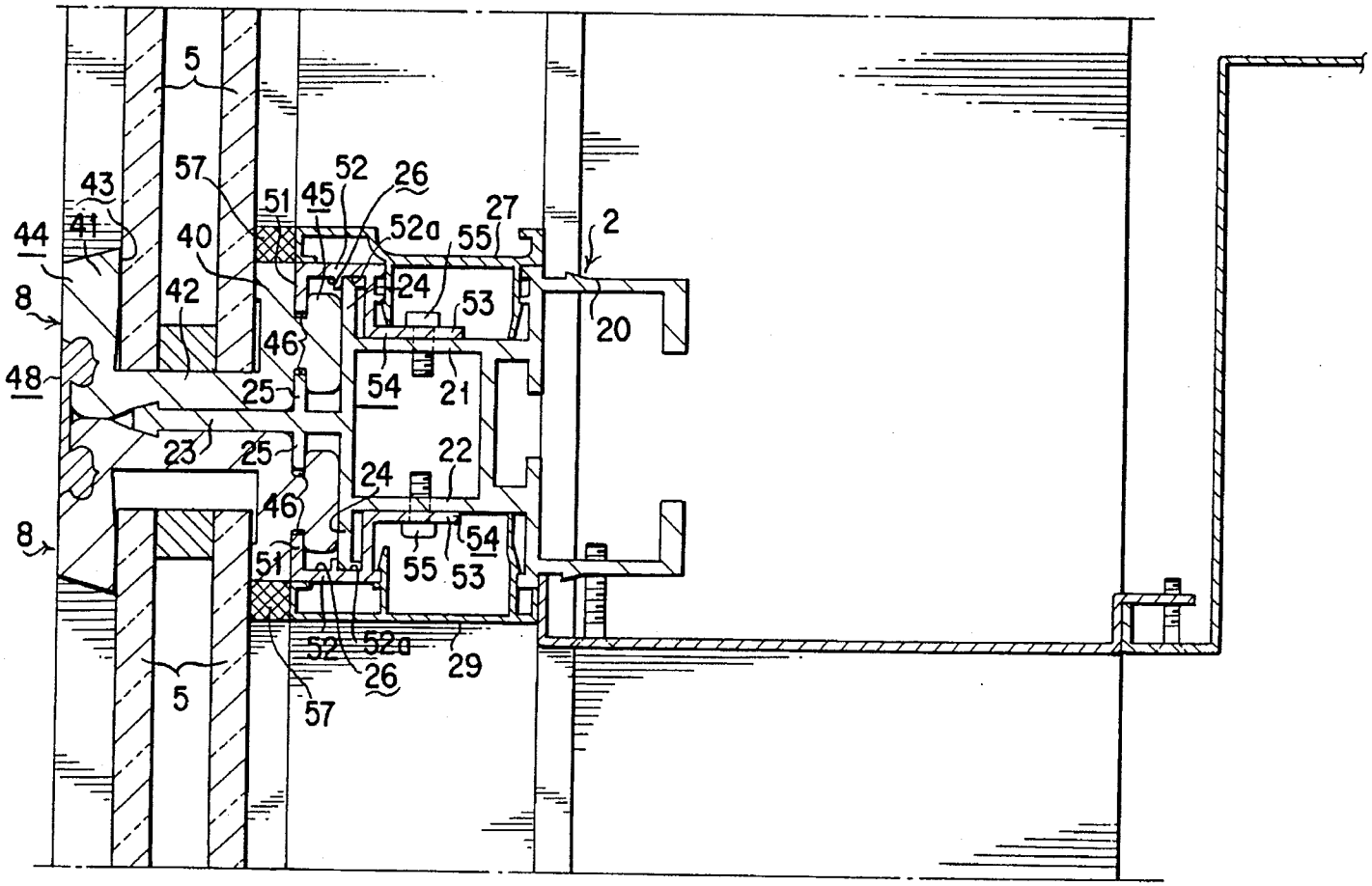
FIG. 6 is a vertical section of the second embodiment of a curtain wall at the portion of a transom.

FIGS. 5 and 6 show a second embodiment of the panel mounting structure according to the invention, where the gasket holding piece is provided separately from the mullion attachment and the transom attachment.

As shown in FIGS. 5 and 6, a gasket holder 54 comprises a gasket holding piece 51, a L-shaped piece 52 and a mounting piece 53. The mounting piece 53 is rigidly secured onto the mullion 1 by means of fastening bolt 55. The projecting pieces 13 of the mullion 1 and the gasket holder 54 cooperate to define a hollow groove 14.

In the shown construction, a gasket supporting plate 56 is integrally formed with the mullion 1 to project toward the exterior side, and the connecting piece 42 of the vertical gasket 7 has a hollow portion **42*a* cut out on the interior side thereof for accommodating the gasket supporting plate 56**.

Further, in this construction, a pair of projecting plates 11, 11 are integrally formed with the mullion body 10, and the L-shaped plates 12 are formed to be bent toward the interior side so as to be engaged with the L-shaped piece 52 of the gasket holder 54.

As set forth above, according to the present invention, each panel member is supported by a quadrangular gasket fitted around the entire periphery of the panel member, independently of other panel members. First, the quadrangular gasket is fitted to the mullions and transoms, and then the panel member is fitted in the quadrangular gasket by deforming the exterior side holding pieces of the vertical and horizontal gaskets toward the exterior side, or alternatively, the quadrangular gasket is first fitted around the entire periphery of the panel member, and then the panel member having the quadrangular gasket fitted around the periphery is mounted onto the mullions and transoms. In each case, at this stage of mounting process, the panel member is temporarily being held by the interior side receiving pieces and exterior side holding pieces of the vertical and horizontal gaskets. And then, in this condition, the zippers are fitted to the gaskets. Therefore, installation operation of the quadrangular gasket as well as fitting operation of the zippers can be performed easily, especially because the latter is performed in the condition that the panel member is temporarily held. Thus, the present invention considerably facilitates the panel mounting operation as a whole.

Further, since the horizontally adjacent vertical gaskets are jointed by the zipper and the vertically adjacent horizontal gaskets are also jointed by the zipper, penetration of rain water and so forth through between the vertical gaskets and between the horizontal gaskets is prevented, and in addition, displacement of the vertical gaskets between or independent of each other as well as displacement of the horizontal gaskets between or independent of each other are prevented so that the panel member is supported firmly.

Although the invention has been illustrated and described with respect to exemplary embodiments thereof, it should be understood by those skilled in the art that the foregoing and various other changes, omissions and additions may be made therein and thereto, without departing from the spirit and scope of the present invention. Therefore, the present invention should not be understood as limited to the specific embodiments set forth above.

What is claimed is:

1. A panel member mounting structure for a curtain wall comprising:

a frame body formed by a plurality of mullions and a plurality of transoms so as to comprise a plurality of quadrangular frame sections;

a plurality of quadrangular gaskets each formed by a pair of vertical gaskets and a pair of horizontal gaskets integrally connected in a quadrangular configuration and each installed on the exterior side of mullions and transoms defining one of said quadrangular frame sections so as to hold a panel member to be mounted in said quadrangular frame section each of said vertical and horizontal gaskets having a gasket main body and a mounting portion integrally formed with said gasket main body on the interior side thereof, said gasket main body having a panel member receiving groove defined by an interior side receiving piece and an exterior side holding piece integrally connected through a connecting piece and a hollow portion provided in a connecting area of said exterior side holding piece and said connecting piece and opening to the exterior side so as to make said exterior side holding piece deformable toward the exterior side; and a plurality of zippers each having a pair of fitting projections integrally connected through a connecting plate and fitted between a pair of said hollow portions of horizontally adjacent vertical gaskets so as to join and cover contact edges of said horizontally adjacent vertical gaskets and fitted between a pair of said hollow portions of vertically adjacent horizontal gaskets so as to join and cover contact edges of said vertically adjacent horizontal gaskets.

2. A panel member mounting structure as set forth in claim 1, wherein said mullion has a mullion body located on the interior side and a projecting plate integrally formed on the exterior side of said mullion body to project toward the exterior side, said projecting plate has a pair of left and right L-shaped plates in the vicinity of the exterior side end and a pair of projecting pieces on the exterior side end, and said L-shaped plates and said projecting pieces cooperate to define a pair of vertically extending left and right hollow grooves each opening to the exterior side for receiving said mounting portion of said vertical gasket.

3. A panel member mounting structure as set forth in claim 2, wherein an attachment having a gasket holding piece is fitted between said mullion main body and said L-shaped plate.

4. A panel member mounting structure as set forth in claim 1, wherein said transom has a transom body located on the interior side, an upper and lower horizontal plates each integrally formed on the exterior side of said transom body to project toward the exterior side and a panel member supporting plate integrally extending from the exterior side end of said lower horizontal plate toward the exterior side, said lower horizontal plate has a pair of upper and lower L-shaped plates in the vicinity of the exterior side end and a pair of upper and lower projecting pieces on the exterior side end, and said L-shaped plates and said projecting pieces cooperate to define a pair of horizontally extending upper and lower hollow grooves each opening to the exterior side for receiving said mounting portion of said horizontal gasket.

5. A panel member mounting structure as set forth in claim 4, wherein an attachment having a gasket holding piece is fitted between at least one of said upper horizontal plate and said upper L-shaped plate and between said transom body and said lower L-shaped plate.

6. A panel member mounting structure as set forth in claim 1, wherein said mullion has a mullion body located on the interior side and a pair of projecting plates integrally formed on the exterior side of said mullion body to project toward the exterior side, a gasket supporting plate having a pair of left and right projecting pieces is integrally formed with said mullion to project toward the exterior side, a pair of gasket holders each having a gasket holding piece are connected to said mullion, and said projecting pieces and said gasket holders cooperate to define a pair of vertically extending left and right hollow grooves each opening to the exterior side for receiving said mounting portion of said vertical gasket.

7. A panel member mounting structure as set forth in claim 6, wherein an attachment is fitted between said mullion body and said gasket holder.

8. A panel member mounting structure as set forth in claim 1, wherein said transom has a transom body located on the interior side and upper and lower horizontal plates each integrally formed on the exterior side of said transom body to project toward the exterior side, a panel member supporting plate having a pair of upper and lower projecting pieces is integrally formed with said transom to project toward the exterior side, a pair of gasket holders each having a gasket holding piece are connected to said transom, and said projecting pieces and said gasket holders cooperate to define a pair of horizontally extending upper and lower hollow grooves each opening to the exterior side for receiving said mounting portion of said horizontal gasket.

9. A panel member mounting structure as set forth in claim 8, wherein an attachment is fitted between said transom body and said gasket holder.

10. A panel member mounting structure as set forth in claim 3 or 6, wherein said vertical gasket has a pair of grooves formed between said mounting portion and said interior side receiving piece of said gasket main body, and said projecting piece and said gasket holding piece are inserted into said grooves respectively.

11. A panel member mounting structure as set forth in claim 5 or 8, wherein said horizontal gasket has a pair of grooves formed between said mounting portion and said interior side receiving piece of said gasket main body, and said projecting piece and said gasket holding piece are inserted into said grooves respectively.

12. A panel member mounting structure as set forth in claim 1, wherein said plurality of zippers comprises zippers of cross configuration each fitted at a joint point of four quadrangular frame sections and integrally jointing and covering contact edges of a pair of vertical gaskets extending upwardly from said joint point, a pair of vertical gaskets extending downwardly from said joint point, a pair of horizontal gaskets extending to the left from said joint point and a pair of horizontal gaskets extending to the right from said joint point.

13. A panel member mounting structure as set forth in claim 1, wherein said plurality of zippers comprises zippers each extending vertically beyond at least one quadrangular frame section and jointing and covering contact edges of vertically adjacent pairs of vertical gaskets continuously.

14. A panel member mounting structure as set forth in claim 1, wherein said plurality of zippers comprises zippers each extending horizontally beyond at least one quadrangular frame section and jointing and covering contact edges of horizontally adjacent pairs of horizontal gaskets continuously.

15. A panel member mounting structure as set forth in claim 3, 5, 7 or 9, wherein wet type seal member is filled between the interior side surface of said panel member and the exterior side surface of said attachment.

16. A panel member mounting structure as set forth in claim 1, wherein said quadrangular gasket has a stiffness sufficient for temporarily supporting said panel member on said quadrangular frame section before said zipper is fitted.

* * * * *

UNITED STATES PATENT AND TRADEMARK OFFICE

CERTIFICATE OF CORRECTION

PATENT NO. : 5,598,672

DATED : February 04, 1997

INVENTOR(S) : Koichiro NAWA

It is certified that error appears in the above-indentified patent and that said Letters Patent is hereby corrected as shown below:

Claim 4, column 8, line 63, before "upper", delete "an".

Signed and Sealed this

Fifteenth Day of July, 1997

*Attest:*

*Attesting Officer*

BRUCE LEHMAN

*Commissioner of Patents and Trademarks*